US012320365B2

(12) United States Patent
Lei

(10) Patent No.: US 12,320,365 B2
(45) Date of Patent: Jun. 3, 2025

(54) GUIDING MECHANISM, CENTRIFUGAL FAN THEREOF, AND RANGE HOOD THEREOF

(71) Applicant: NINGBO FOTILE KITCHEN WARE CO., LTD., Zhejiang (CN)

(72) Inventor: Gai Lei, Zhejiang (CN)

(73) Assignee: NINGBO FOTILE KITCHEN WARE CO., LTD., Zhejiang (CN)

( * ) Notice: Subject to any disclaimer, the term of this patent is extended or adjusted under 35 U.S.C. 154(b) by 640 days.

(21) Appl. No.: 17/768,860

(22) PCT Filed: Oct. 29, 2020

(86) PCT No.: PCT/CN2020/124783
§ 371 (c)(1),
(2) Date: Apr. 14, 2022

(87) PCT Pub. No.: WO2022/077586
PCT Pub. Date: Apr. 21, 2022

(65) Prior Publication Data

US 2023/0151823 A1 May 18, 2023

(30) Foreign Application Priority Data

Oct. 13, 2020 (CN) ..... 202011091494.0

(51) Int. Cl.
*F04D 29/44* (2006.01)
*F04D 17/08* (2006.01)
(Continued)

(52) U.S. Cl.
CPC ..... *F04D 29/441* (2013.01); *F04D 17/08* (2013.01); *F04D 29/667* (2013.01); *F24C 15/20* (2013.01)

(58) Field of Classification Search
CPC ..... F04D 29/441; F04D 17/08; F04D 29/667; F04D 25/166; F04D 29/4226;
(Continued)

(56) References Cited

U.S. PATENT DOCUMENTS

2012/0328969 A1* 12/2012 DeWald ..... F04D 17/16 415/66
2017/0016629 A1* 1/2017 Jiang ..... F04D 29/46

FOREIGN PATENT DOCUMENTS

CN 2924364 7/2007
CN 203362556 12/2013
(Continued)

OTHER PUBLICATIONS

"International Search Report (Form PCT/ISA/210) of PCT/CN2020/124783," mailed on Jul. 16, 2021, pp. 1-5.

*Primary Examiner* — Aaron R Eastman
(74) *Attorney, Agent, or Firm* — JCIPRNET

(57) ABSTRACT

A guiding mechanism, includes a guiding surface enclosed by a first curve segment, a second curve segment, a third curve segment and a first straight line segment; a starting point of the first curve segment is defined as an origin of coordinates, two perpendicular straight lines passing through the origin of coordinates on a plane where the first curve segment is located are respectively defined as X-axis and Y-axis, and a line perpendicular to both the X-axis and the Y-axis is defined as Z-axis; coordinates of an ending point of the first curve segment is (x3,y3), x3≠0 and y3≠0. The present invention also discloses a centrifugal fan and a range hood.

10 Claims, 4 Drawing Sheets

(51) Int. Cl.
*F04D 29/66* (2006.01)
*F24C 15/20* (2006.01)

(58) Field of Classification Search
CPC ..... F04D 29/626; F04D 17/16; F04D 29/42;
F04D 29/4246; F24C 15/20
See application file for complete search history.

(56) References Cited

FOREIGN PATENT DOCUMENTS

| | | |
|---|---|---|
| CN | 203614460 | 5/2014 |
| CN | 106257057 | 12/2016 |
| CN | 107023867 | 8/2017 |
| CN | 207006315 | 2/2018 |
| CN | 207778531 | 8/2018 |
| CN | 111503699 | 8/2020 |
| JP | H07293498 | 11/1995 |
| WO | 2016047070 | 3/2016 |

* cited by examiner

GUIDING MECHANISM, CENTRIFUGAL FAN THEREOF, AND RANGE HOOD THEREOF

CROSS-REFERENCE TO RELATED APPLICATION

This application is a 371 of international application of PCT application serial no. PCT/CN2020/124783, filed on Oct. 29, 2020, which claims the priority benefit of China application no. 202011091494.0, filed on Oct. 13, 2020. The entirety of each of the above mentioned patent applications is hereby incorporated by reference herein and made a part of this specification.

TECHNICAL FIELD OF THE INVENTION

The present invention relates to the technical field of range hoods, and in particular to a guiding mechanism, a centrifugal fan thereof, and a range hood thereof.

BACKGROUND OF THE INVENTION

Range hoods have become one kind of indispensable kitchen appliances in modern families. Range hoods operate on the principle of fluid dynamics, suck and exhaust oil fume through centrifugal fans mounted inside the range hoods and filter some oil particles through filter screens. The centrifugal fan comprises a volute, an impeller mounted in the volute and a motor for driving the impeller to rotate. When the impeller rotates, a negative-pressure suction force is generated in the center of the fan, so that oil fume under the range hood is sucked into the fan, accelerated by the fan and then collected by the volute and guided to the outside.

For thin range hoods, fan systems are generally arranged horizontally, and air outlets mainly discharge air from the top. For example, a Chinese patent CN207006315U (patent NO.: 201720917014.9) disclosed an ultra-thin ceiling-mounted range hood, at least comprising a housing and an air supply component, wherein the air supply component comprises a fan volute, a motor matched with the fan volute and an impeller; the fan volute comprises a front cover having an air inlet and an middle annular wall; the middle annular wall vertically connects the front cover by using a continuous smoothly-transited curved surface to form an inner flow passage opened upward and an air supply port.

As described above, most of the existing range hoods discharge air from the top. After an air flow enters the fan system and is sucked centrifugally by the impeller to provide energy, the air flow is discharged through the volute. The gas that basically rotates and flows horizontally in the volute is forced to turn before discharge and then discharged upward. In the process of turning the flow by the volute and discharging upward the flow, a guide plate is disposed in the rear of the volute, so that an internal flow field is relatively smooth. Therefore, at present, arc-shaped structures having a two-dimensional cross section are generally disposed at the rear air outlets of the existing range hoods.

For example, a Chinese patent application CN111503699A (application NO.: 202010463696.7) disclosed a fume discharge pipe, comprising a pipe body and a flow division member, wherein the pipe body is configured to communicate with a volute of a range hood; the flow division member is disposed in the pipe body; the flow division member comprises a first flow division portion having a first air guide surface; the first flow division portion corresponds to a position where oil fume with a flowing component passes therethrough; and, the first air guide surface is inclined to the length direction of the pipe body and disposed away from the volute tongue of the volute.

Since the movement of the air flow at the outlet of the volute is relatively complex and the caused air flow noise is relatively high, the arc-shaped structure can only slightly reduce the noise without any obvious improvement.

SUMMARY OF THE INVENTION

It is a first object of the present invention to provide a guiding mechanism, which effectively guides an air flow to make a turn, reduces the energy loss and aerodynamic noise during turning and reduces the noise at an outlet of a volute.

It is a second object of the present invention to provide a centrifugal fan equipped with the guiding mechanism described above.

It is a third object of the present invention to provide a range hood equipped with the centrifugal fan described above.

For achieving the first object, the guiding mechanism comprises a guiding surface; characterized in that: the guiding surface is enclosed by a first curve segment, a second curve segment, a third curve segment and a first straight line segment, and the first curve segment, the third curve segment, the first straight line segment and the second curve segment are connected end to end in turn; a starting point of the first curve segment is defined as an origin of coordinate, two perpendicular straight lines passing through the origin of coordinates on a plane where the first curve segment is located are respectively defined as X-axis and Y-axis, and a line perpendicular to both the X-axis and the Y-axis is defined as Z-axis; the coordinates of an ending point of the first curve segment is (x3,y3), $x3 \neq 0$ and $y3 \neq 0$; and the Z-coordinates of a starting point and an ending point of the first straight line segment are not equal to 0.

In order to adapt to the outlet of the flow field and reduce the air flow impact, preferably, the first curve segment comprises a second straight line segment and a fourth curve segment connected in turn; a starting point of the second straight line segment is the starting point of the first curve segment, the second straight line segment is located on the X-axis; an ending point of the fourth curve segment is the ending point of the first curve segment, and the fourth curve segment is a Bezier curve.

In order to adapt to the diverging process of the outlet of the flow field and reduce the air flow impact at the inlet end of the flow collector, preferably, the second curve segment is a logarithmic spiral line.

In order to better adapt to the range of working conditions of a high flow, preferably, the third curve section is an angle-variable logarithmic spiral line having a gradually increasing divergence angle or a gradually decreasing divergence angle.

In order to further improve the flow guide effect and restrain the air flow instability caused by uneven air flows such as vortex near the guiding mechanism, preferably, the guiding surface has a guiding piece, the guiding piece extends between the first curve segment and the first straight line segment, and the guiding piece also extends from the guiding surface in a direction away from the guiding surface.

In order to guide the flow near the outlet of the volute tongue from the outlet of the impeller, guide the air flow to be discharged from the air outlet and reduce the vortex at the volute tongue, preferably, an inclined angle is formed between the guiding piece and the XY plane where the first curve segment is located.

In order to further guide the air flow and reduce the vortex at the volute tongue, preferable, the projected length of the first curve segment on the XY plane is L2, the vertical distance between projections of the end of the guiding piece close to the first straight line segment (FE) and the ending point of the first curve segment on the XZ plane is L1, and L2:L1∈[2:1,5:2].

For achieving the second object, the centrifugal fan equipped with the guiding mechanism described above comprises a volute having an air inlet and an air outlet, and an impeller disposed inside the volute; characterized in that the orientation of the air outlet is parallel to an axis of the impeller, and the guiding mechanism is disposed inside the volute and corresponds to the air outlet, and the air discharged in the radial direction of the impeller is guided to the air outlet.

Preferably, the guiding mechanism corresponds to the specific position of the volute: the volute comprises a front cover, a rear cover and an annular wall connected between the front cover and the rear cover; the air inlet is formed on the front cover, the air outlet is formed on the rear cover, the annular wall has a volute tongue adjacent to the air outlet; both the first curve segment and the first straight line segment extend between two opposite sides of the annular wall, the second curve segment is located on a side of the annular wall away from the volute tongue, while the third curve segment is located on a side of the annular wall close to the volute tongue; the first curve segment is close to the rear cover of the volute, and the first straight line is close to the front cover of the volute.

In order to adapt to the size of the volute tongue and better fit with the volute tongue, preferably, the third curve segment deflects toward the second curve segment near an ending point of the third curve segment.

For achieving the third object, the range hood is characterized by equipping with the centrifugal fan described above; wherein the air inlet faces downward, and the air outlet faces upward; and the range hood further comprises an air outlet hood disposed on the air outlet.

Compared with the prior art, the present invention has the following advantages. The guiding surface is designed as a curved surface consisting of three curves, so that the guiding mechanism can effectively guide an air flow to make a turn, the energy loss of turning and aerodynamic noise are reduced. In addition, since guiding pieces are disposed on the guiding surface, the flow guide effect can be improved, and the air flow instability caused by uneven air flows such as vortex near the guiding mechanism can be restrained, therefore the noise is reduced.

The centrifugal fan and range hood using the guiding mechanism also have the above advantages.

DETAILED DESCRIPTION OF THE EMBODIMENTS

Figure 1:
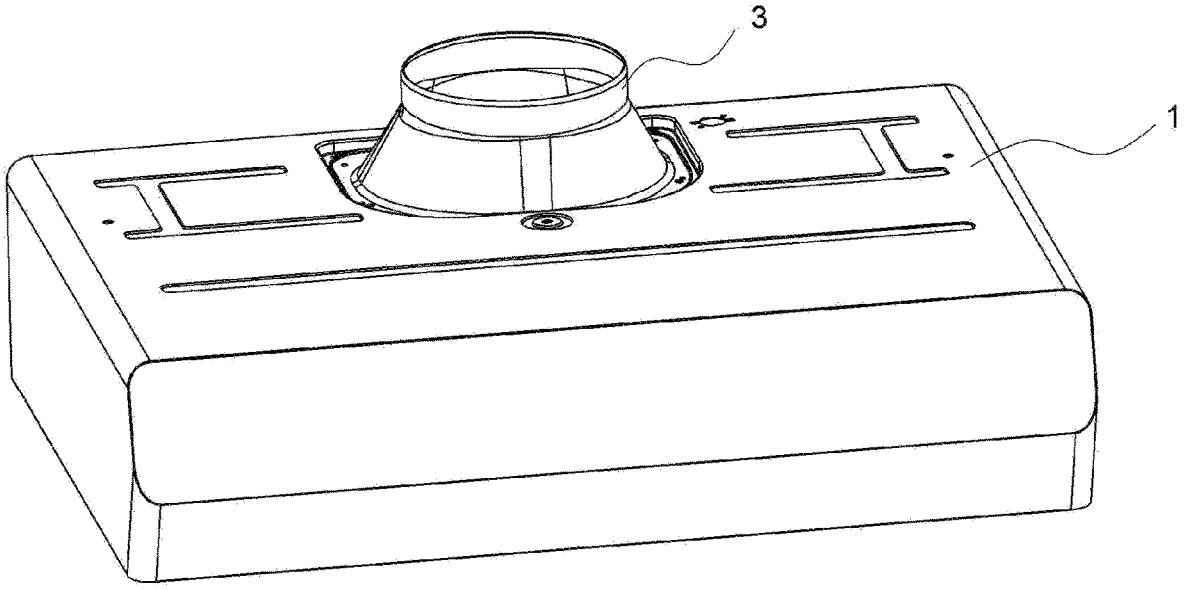
FIG. 1 is a perspective view of a range hood of an embodiment according to the present invention.
Figure 2:
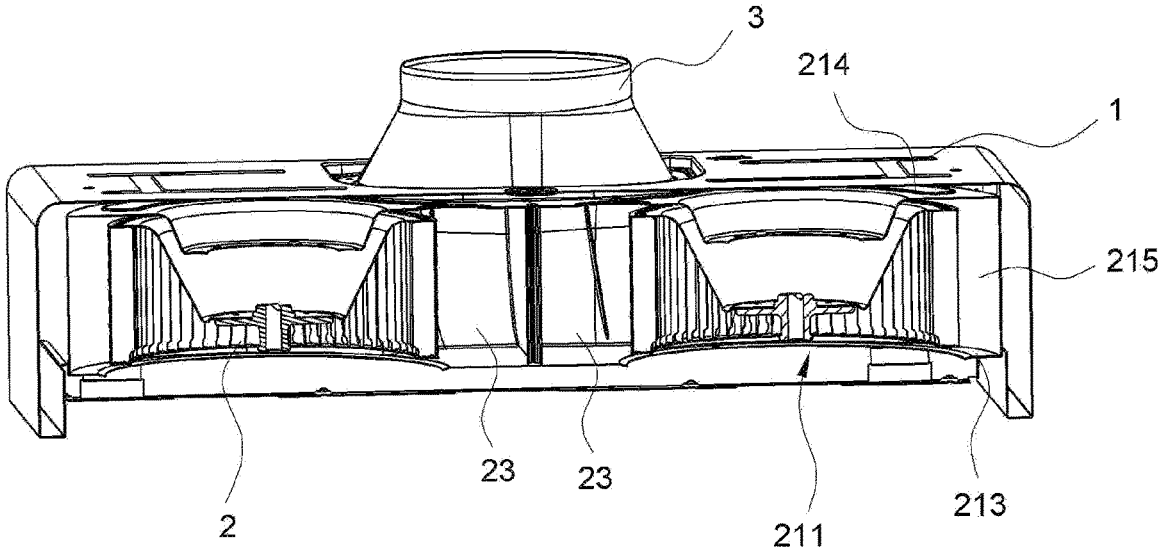
FIG. 2 is a sectional view (longitudinally sectional view) of the range hood of the embodiment according to the present invention.
Figure 3:
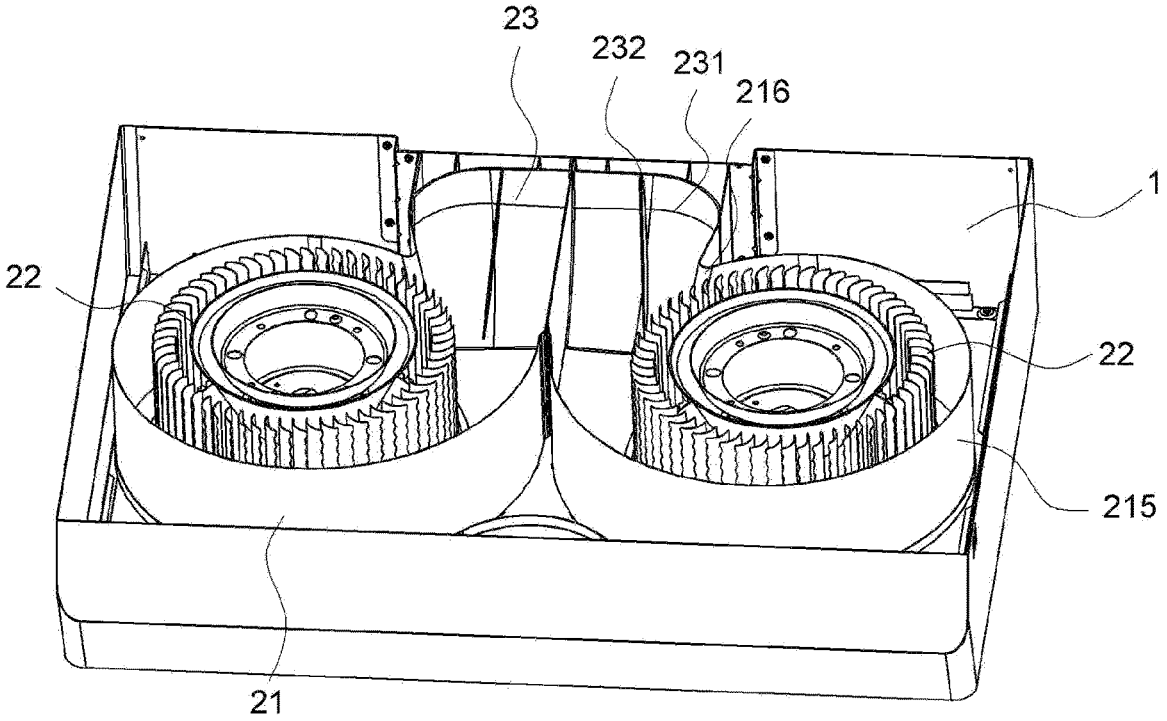
FIG. 3 is a sectional view (transversely sectional view) of the range hood of the embodiment according to the present invention.
Figure 4:
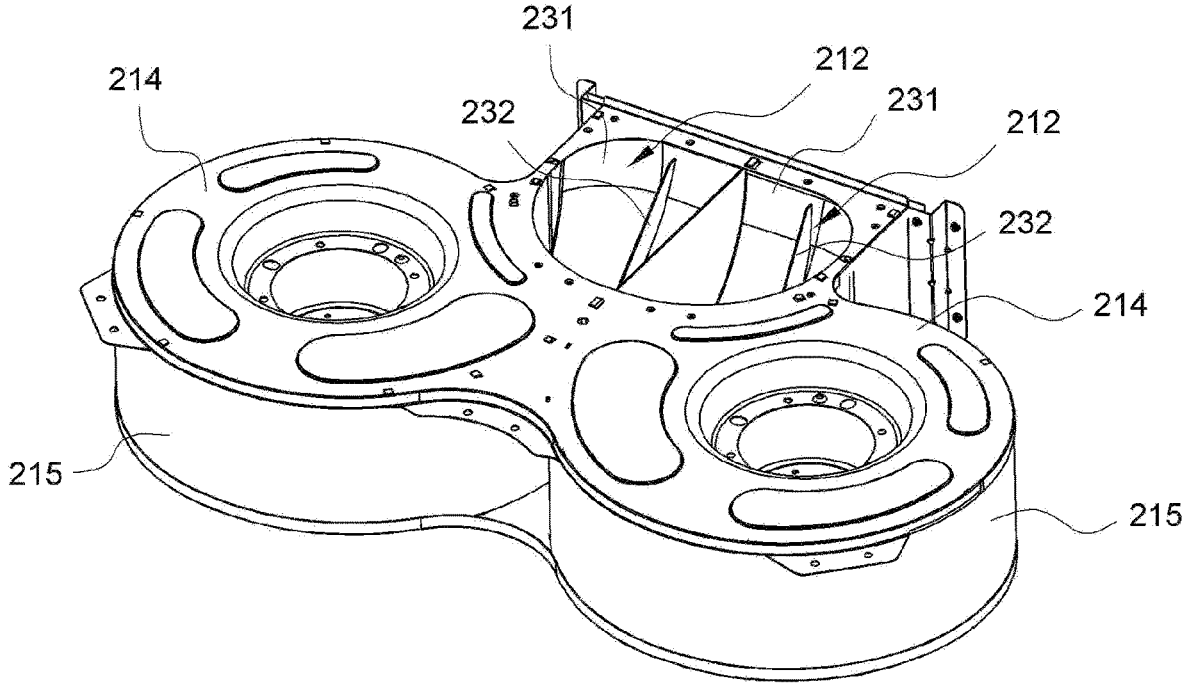
FIG. 4 is a perspective view of a centrifugal fan of the range hood of the embodiment according to the present invention.
Figure 5:
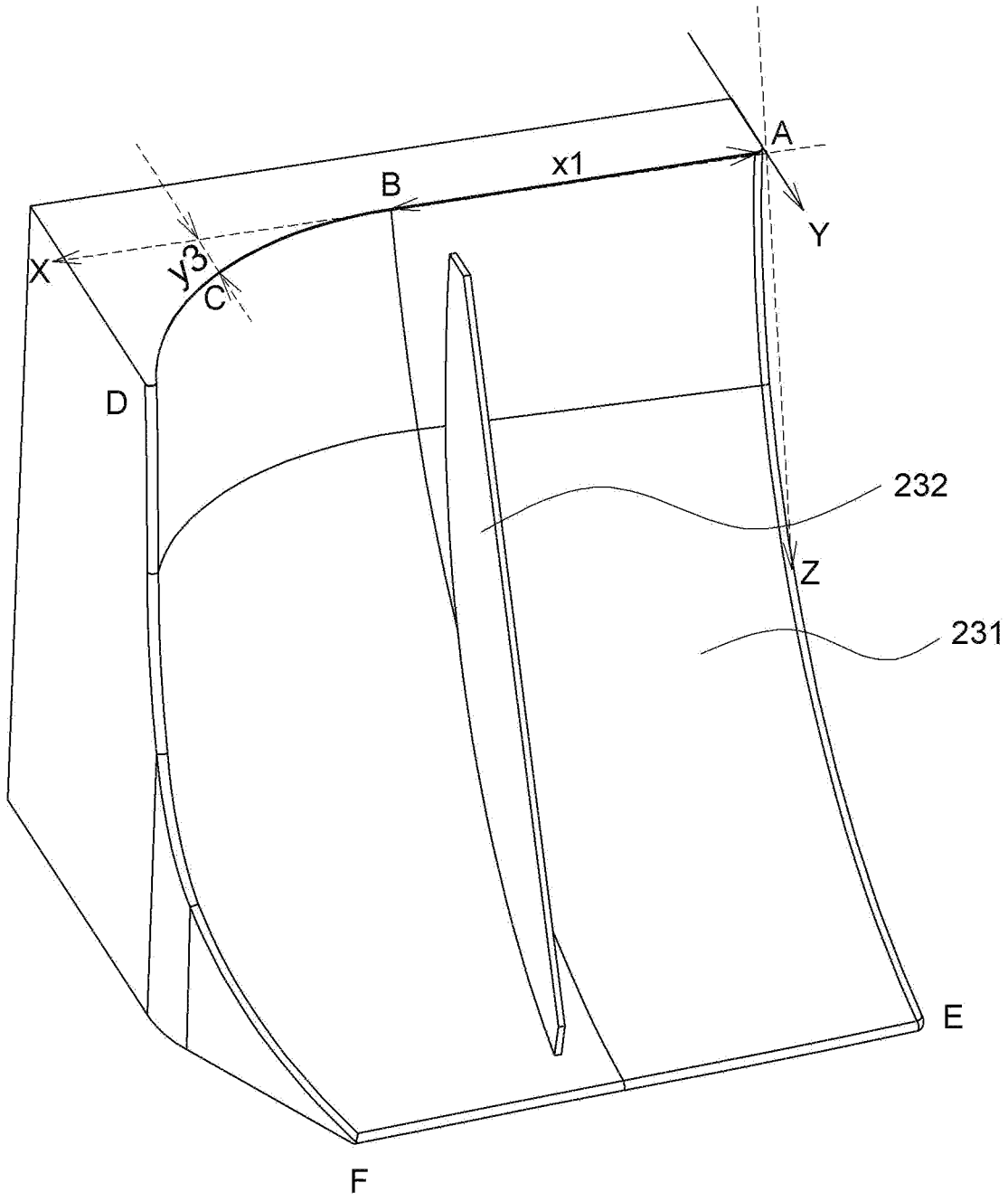
FIG. 5 is a perspective view of a guiding mechanism of the range hood of the embodiment according to the present invention.

The embodiments of the present invention will be described below in detail. The examples of these embodiments have been illustrated in the accompanying drawings throughout which same or similar reference numbers indicate same or similar elements or elements having same or similar functions.

It is to be noted that, in the description of this embodiment, orientations or location relationships indicated by terms such as "center", "lengthways", "transverse", "length", "width", "thickness", "up", "down", "front", "rear", "left", "right", "vertical", "horizontal", "top", "bottom", "inside", "outside", "clockwise", "anticlockwise", "axial", "radial", "circumference" are the orientations and location relationships illustrated on the basis of the accompany drawings. Such terms are used just for ease of describing the present invention and simplifying the description, and it is not indicated or implied that the stated device or element must have a specific orientation or must be constructed and operated in the specific orientation, the embodiment of the present invention can be set in different directions, and shall not be interpreted as any limitation to the present invention. For example, "up" and "down" are not always limited to directions opposite or consistent with the direction of gravity. In addition, features that qualify as "first" or "second" may comprise, explicitly or implicitly, one or more of these features.

FIGS. 1-4 show a preferred embodiment of the range hood according to the present invention. The range hood in this embodiment is a thin-type range hood. The thin-type range hood refers to a kitchen appliance that generally does not exceed 220 mm in the overall height of the range hood, and can quickly exhaust the wastes produced by burning of the cooker and the oil fume harmful to the human body produced during the cooking process to the outside after it is mounted above the kitchen cooker, and can also condensate and collect the oil fume to reduce pollution and purify the air in the kitchen.

The range hood comprises a fume collection hood 1, a fan system disposed inside the fume collection hood 1, and an air outlet hood 3. The fan system comprises two centrifugal fans 2 disposed in parallel. Alternatively, the fan system may also have a single fan.

Each centrifugal fan 2 comprises a volute 21, an impeller 22 disposed inside the volute and a motor (not shown) for driving the impeller 22 to rotate. An air inlet 211 and an air outlet 212 are formed on the volute 21. The volute 21 comprises a front cover 213, a rear cover 214 and an annular wall 215 connected between the front cover 213 and the rear cover 214. The air inlet 211 is formed on the front cover 213, the air outlet 212 is formed on the rear cover 214, the annular wall 215 has a volute tongue 216 adjacent to the air outlet 212.

Since the thin range hood is limited by the overall height, the arrangement mode of the fan system is basically determined, and the fan system can only be arranged horizontally. The volute 21 and the impeller 22 are arranged such that the air inlet 211 on the volute 21 faces downward and the air outlet on the volute 21 faces upward. Oil fume or other air flows are sucked from the air inlet 211 of the fan, then centrifuged at a high speed by the impeller 22, pressurized by the volute 21 and discharged through the air outlet 212. The air outlet hood 3 is disposed on the top of the fume collection hood 1 and corresponds to the air outlet 212. The flowing direction of the air flow in the air outlet hood 3 is an upward direction.

Thus, during the oil fume suction and discharge process, when the air flow is discharged through the volute 21, the air flows needs to make a 90° turn, so that high noise will be produced during this process. The arrangement mode of the air outlet 212 is different from that of the existing centrifugal fans. The air outlet in the existing centrifugal fans is consistent with the air outlet direction of the impeller. In order to improve the noise at this position, the centrifugal fan 2 further comprises a guiding mechanism 23 and disposed at a position in the volute 21 corresponding to the air outlet 212. The guiding mechanism 23 guides an air flow that flows out in the radial direction to flow to the air outlet hood 3 in the axial direction, so that the air flow can be effectively guided to make a turn and the energy loss and aerodynamic noise during turning are reduced.

With reference to FIGS. 2-7, in order to adapt to the law of movement at the air outlet 212, the guiding mechanism 23 comprises a guiding surface 231, and the guiding surface 231 is protruded in a direction away from the air flow as a whole. The guiding surface 231 is in a three-dimensional curved surface, and is enclosed by a first curve segment AD, a second curve segment EA, a third curved segment DF and a first straight line segment FE, wherein both the first curve segment AD and the first straight line segment FE extend between two opposite sides of the annular wall 215, the second curve segment EA is located on a side of the annular wall 215 away from the volute tongue 216, while the third curve segment DF is located on a side of the annular wall 215 close to the volute tongue 216. The first curve segment AD, the third curve segment DE, the first straight line segment FE and the second curve segment EA are connected end to end in turn, and the ending point A of the second curve segment EA is the starting end A of the first curve segment AD. The first curve segment AD is close to the rear cover 214 of the volute 21, and the first straight line FE is close to the front cover 213 of the volute 21.

The first curve segment AD is located on a same plane, and comprises a second straight line segment AB and a fourth curve segment BD connected in turn. The fourth curve segment BD is a Bezier curve. A Cartesian coordinate system is established, where the starting point A of the first curve segment AD is used as an origin of coordinates, a line passing through the second straight line segment AB is used as X-axis, Y-axis is located on a plane where the first curve segment AD is located and perpendicular to X-axis, and Z-axis is perpendicular to both X-axis and Y-axis. The Z-axis is parallel to the axis of the impeller 22, and the Z-axis coordinates of the starting end F and ending point E of the first straight line segment FE are not equal to 0, for example, being greater than 0. The plane where the first curve segment AD is located is the XY plane. When the guiding mechanism 23 is disposed in the range hood of the present invention, the X-axis is a left-right direction, the Y-axis is a front-rear direction, and the Z-axis is an up-down direction.

A point C is selected on the fourth curve segment BD. The coordinates of points corresponding to the points on the first curve segment AD are respectively A(0,0), B(x1,0), C(x2, y2) and D(x3,y3), where x3≠0 and y3≠0. In this embodiment, y3>y2>0 and x3>x2>x1>0. The second straight line segment AB has a length of x1, that is, the coordinates of point B are (x1,0). Preferably, x1 has a value range of 55 mm to 80 mm, most preferably 68 mm. Y2 has a value range of 40 mm to 70 mm, most preferably 52 mm. The curve can be fitted according to the quadratic equation of Bezier curve: $B(t)=1-t)^2B+2t(1-t)C+t^2D$, $t\in[0,1]$. The point C is a golden section point, and the coordinates of this point are $$x2 = x1 + \frac{\sqrt{5}-1}{2}(x3 - x1) \text{ and } y2 = \frac{\sqrt{5}-1}{2}(x3 - x1).$$

The second curve segment EA and the third curve segment DF adopt a cylindrical coordinate system, wherein the second curve segment EA is preferably a logarithmic spiral line, so that the diverging process of the outlet of the flow field is adapted and the air flow impact at the inlet end of the flow collector can be reduced. The equation of the logarithmic spiral line of the second curve segment EA is Y=R1*exp(θ), where the size of R1 is the height of the guiding mechanism 23 (the height of the guiding mechanism 23 is defined as the vertical distance from the first straight line segment FE to the plane where the first curve segment AD is located), the starting point of the second curve segment EA is the point E, and 0 is the polar coordinate angle variable of any point on the second curve segment EA.

In order to better adapt to the range of working conditions of a high flow, the third curve section DF is an angle-variable logarithmic spiral line having a gradually increasing divergence angle or a gradually decreasing divergence angle. The equation of the logarithmic spiral line with a variable spiral angle is Y=R1*exp(θ'*tan(λ1)), where the variable spiral divergence angle λ1 satisfies the following condition: λ1∈[1°, 10°]; the size of R1 is the height of the guiding mechanism 23; the starting point of the third curve segment DF is the point F; and, θ' is the polar coordinate angle variable of any point on the third curve segment DF. The third curve segment DF is close to the edge of the air outlet 212. At the inlet of the flow field near the volute tongue 216, since the discharge of the air flow is limited by the air outlet 212, the air outlet hood 3 and other structures, the velocity of the flow field is relatively low.

The third curve segment DF deflects toward the second curve segment EA near the ending point F. The deflected part corresponds to the volute tongue 216 (particularly the R-variable volute tongue), so that the size of the volute tongue 216 is adapted and it is better fitted with the volute tongue 216.

The first straight line segment FE is located outside the plane where the first curve segment AD is located. In this embodiment, the first straight line FE is parallel to the plane where the first curve segment AD is located, and parallel to the second straight line segment AB.

The guiding surface 231 has a guiding piece 232, the guiding piece 232 extends between the first curve segment AD and the first straight line segment FE (the extension direction is the length direction of the guiding pieces 232), and the guiding piece 232 also extends from the guiding surface 231 in a direction away from the guiding surface 231 (the extension direction is the height direction of the guiding pieces 232, that is, the guiding pieces extend between the front cover 213 and the rear cover 214 of the volute 21).

Figure 6:
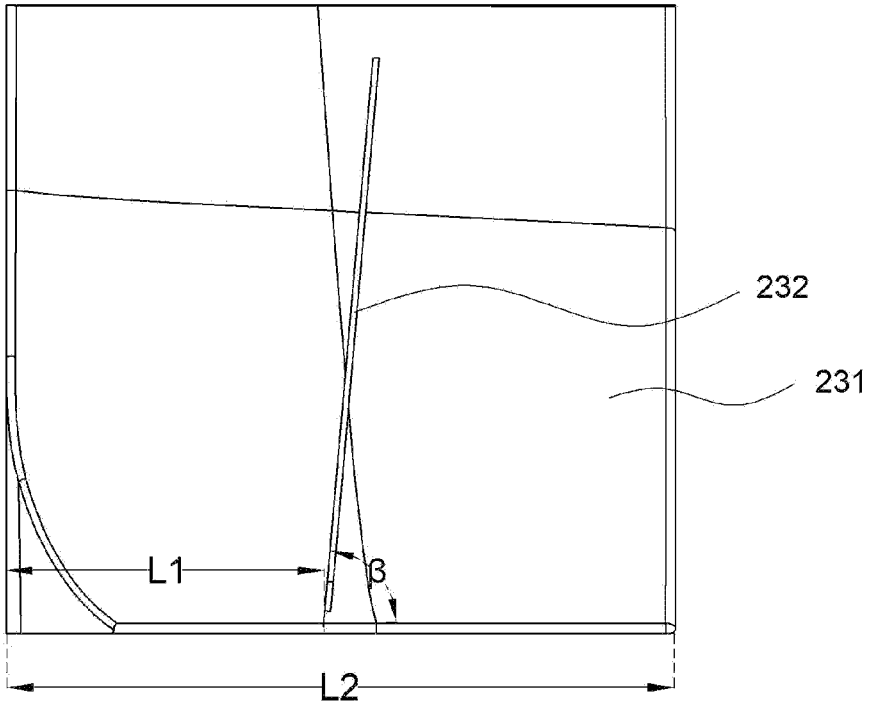
FIG. 6 is a front view of FIG. 5.
Figure 7:
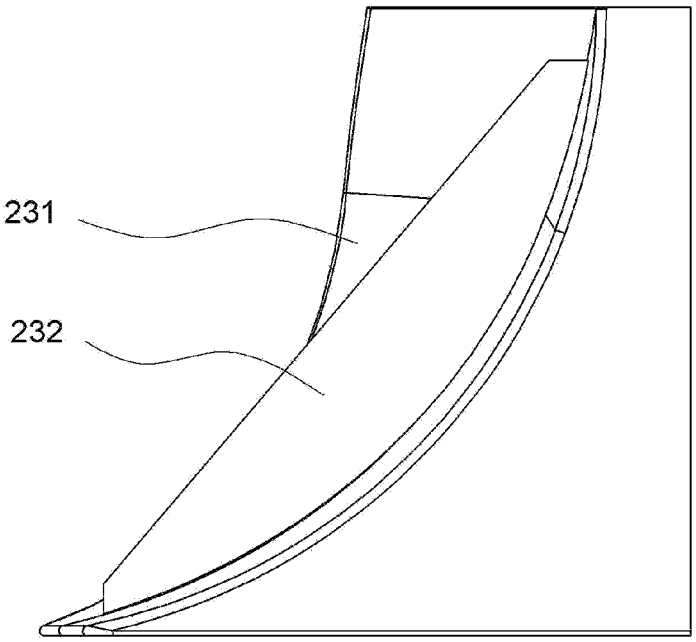
FIG. 7 is a side view of FIG. 5.

With reference to FIG. 6, both the bottom surface of the guiding mechanism 23 close to the front cover 213 and the top surface of the guiding mechanism 23 close to the rear cover 214 are planes. The guiding surface 231 extends between the bottom surface and the top surface (that is, the plane where the first curve segment AD is located, which is parallel to the bottom surface), and both the bottom surface and the top surface are parallel to the front cover 213 (rear cover 214), so that the guiding mechanism 23 is a horizontal plane when it is mounted in the range hood. There is a certain inclined angle β between the guiding pieces 232 and the bottom surface. Preferably, β∈[70°,88°]. The inclined angle β is mainly used to guide the flow from the outlet of the impeller 22 to the outlet of the volute tongue 216, so that the air flow is guided to the air outlet 212 for discharging and the vortex at the volute tongue 216 is reduced. The projected length of the first curve segment AD on the XZ plane is L2, and the vertical distance between projections of the ends of the guiding piece 232 on the XZ plane close to the first straight line segment FE and the projection of the ending point D (that is, the distance in a direction parallel to the X-axis) is L1. Preferably, L2:L1∈[2:1,5:2]. The best value of L2:L1 is 20:9.

With reference to FIG. 6, a certain distance is reserved between the guiding pieces 232 and the top surface of the guiding mechanism 23, so that a buffer space can be provided for the flow. The sides of the guiding pieces 232 close to the guiding surface 231 are completely fitted with the guiding surface 231. Considering that the guiding pieces 232 mainly function to guide the flow and restrain the air flow instability caused by uneven air flows such as vortex near the guiding mechanism 23, it is only necessary to define the relative positions of the guiding pieces 232 on the left and right of the guiding surface 231 (that is, the L2:L1), the height of the guiding pieces 232 is not greater than 20 mm, so as not to restrain the flow of the main air flow at the air outlet 212.

According to the range hood testing method in GB/T17713-2011, the tests show that the guiding mechanism 23 in the three-dimensional curved surface design is reduced by 0.8 dB in noise in comparison to the two-dimensional arc-shaped guiding mechanism design. After the guiding pieces 232 are additionally disposed on the three-dimensional curved surface, the noise is reduced by 0.6 dB.

What is claimed is:

1. A guiding mechanism, comprising a guiding surface (231), wherein the guiding surface (231) is enclosed by a first curve segment (AD), a second curve segment (EA), a third curve segment (DF) and a first straight line segment (FE), and the first curve segment (AD), the third curve segment (DF), the first straight line segment (FE) and the second curve segment (EA) are connected end to end in turn;

a starting point (A) of the first curve segment (AD) is defined as an origin of coordinates, two perpendicular straight lines passing through the origin of coordinates on a plane where the first curve segment (AD) is located are respectively defined as X-axis and Y-axis, and a line perpendicular to both the X-axis and the Y-axis is defined as Z-axis;

coordinates of an ending point (D) of the first curve segment (AD) is (x3,y3), x3≠0 and y3≠0; and Z-coordinates of a starting point (F) and an ending point (E) of the first straight line segment (FE) are not equal to 0, wherein the first curve segment (AD) comprises a second straight line segment (AB) and a fourth curve segment (BD) connected in turn, wherein a starting point (A) of the second straight line segment (AB) is the starting point (A) of the first curve segment (AD), and the second straight line segment (AB) is located on the X-axis, wherein an ending point (D) of the fourth curve segment (BD) is the ending point (D) of the first curve segment (AD), and the fourth curve segment (BD) is a Bezier curve.

2. The guiding mechanism of claim 1, wherein the second curve segment (EA) is a logarithmic spiral line.

3. The guiding mechanism of claim 1, wherein the third curve section (DF) is an angle-variable logarithmic spiral line having a gradually increasing divergence angle or a gradually decreasing divergence angle.

4. The guiding mechanism of claim 1, wherein the guiding surface (231) has a guiding piece (232), the guiding piece (232) extends between the first curve segment (AD) and the first straight line segment (FE), and the guiding piece (232) also extends from the guiding surface (231) in a direction away from the guiding surface (231).

5. The guiding mechanism of claim 4, wherein an inclined angle (β) is formed between the guiding piece (232) and the XY plane where the first curve segment (AD) is located.

6. The guiding mechanism of claim 5, wherein the projected length of the first curve segment (AD) on the XY plane is L2, the vertical distance between projections of the end of the guiding piece (232) close to the first straight line segment (FE) and the ending point (D) of the first curve segment (AD) on XZ plane is L1, and L2:L1∈[2:1,5:2].

7. A centrifugal fan equipped with the guiding mechanism of claim 1, comprising a volute (21) having an air inlet (211) and an air outlet (212), and an impeller (22) disposed inside the volute (21);

wherein the orientation of the air outlet (212) is parallel to an axis of the impeller (22), and the guiding mechanism is disposed inside the volute (21) and corresponds to the air outlet (212), and the air discharged in the radial direction of the impeller (22) is guided to the air outlet (212).

8. The centrifugal fan of claim 7, wherein the volute (21) comprises a front cover (213), a rear cover (214) and an annular wall (215) connected between the front cover (213) and the rear cover (214);

the air inlet (211) is formed on the front cover (213), the air outlet (212) is formed on the rear cover (214), the annular wall (215) has a volute tongue (216) adjacent to the air outlet (212);

both the first curve segment (AD) and the first straight line segment (FE) extend between two opposite sides of the annular wall (215), the second curve segment (EA) is located on a side of the annular wall (215) away from the volute tongue (216), while the third curve segment (DF) is located on a side of the annular wall (215) close to the volute tongue (216);

the first curve segment (AD) is close to the rear cover (214) of the volute (21), and the first straight line (FE) is close to the front cover (213) of the volute (21).

9. The centrifugal fan of claim 8, wherein the third curve segment (DF) deflects toward the second curve segment (EA) near an ending point (F) of the third curve segment (DF).

10. A range hood, equipping with the centrifugal fan of claim 7, wherein the air inlet (211) faces downward, and the air outlet (212) faces upward; and the range hood further comprising an air outlet hood (3) disposed on the air outlet (212).

* * * * *